United States Patent [19]

Archenholtz et al.

[11] 4,344,652

[45] Aug. 17, 1982

[54] MEANS FOR REMOVING THE LINING OF A CRUCIBLE FURNACE

[75] Inventors: Åke Archenholtz, Västerås; Yngve Caisander; Gustav Haas, both of Helsingborg, all of Sweden

[73] Assignee: ASEA Aktiebolag, Västerås, Sweden

[21] Appl. No.: 132,184

[22] Filed: Mar. 20, 1980

[30] Foreign Application Priority Data

Mar. 23, 1979 [SE] Sweden ..... 7902619

[51] Int. Cl.[3] ..... E21C 3/00

[52] U.S. Cl. ..... 299/70; 110/336; 266/281

[58] Field of Search ..... 266/280, 281; 110/336; 299/70, 72, 75

[56] References Cited

U.S. PATENT DOCUMENTS 3,314,724 4/1967 Tinlin ..... 299/70 X
4,039,175 8/1977 Beckers ..... 266/281
4,068,895 1/1978 Reese et al. ..... 266/281 X
4,239,291 12/1980 Skendrovic ..... 299/70

FOREIGN PATENT DOCUMENTS 388842 6/1973 U.S.S.R. ..... 266/281

*Primary Examiner*—Edward G. Favors
*Attorney, Agent, or Firm*—Watson, Cole, Grindle & Watson

[57] ABSTRACT

An apparatus for removing the lining of a crucible furnace comprises a tubular support which can be introduced into the furnace substantially in the axial direction of the latter. A power-driven tool, for example a pneumatically operated chisel, is movable along the tubular support in engagement with the lining to be removed. Drive means operable from outside the furnace is provided for moving the tool along the tubular support. A suction means is connected to the tubular support for the purpose of extracting, through the tubular support, dust and lining fragments produced during the operation of removing the lining.

12 Claims, 2 Drawing Figures

MEANS FOR REMOVING THE LINING OF A CRUCIBLE FURNACE

TECHNICAL FIELD

This invention relates to an apparatus for removing the lining of a crucible furnace.

When using the conventional method of removing crucible furnace linings wherein the removal work is carried out either in the furnace crucible or immediately above its opening, the person carrying out the work is exposed to a severe dust hazard. As the lining normally consists of quartzite, the dust may give rise to the lung-disease silicosis. The dust from linings of other materials may also give rise to diseases and other environmental inconveniences.

DISCUSSION OF THE PRIOR ART

There are certain tools in existence for removing crucible linings, but these have not been provided with any means for protecting the operators of the tools from the dust hazard. Furthermore, with these known tools it is not possible to precisely control the work of the tool, which control is necessary for an efficient removal of crucible fragments.

British Pat. No. 1,448,954 attempts to solve the dust problem by constructing the furnace bottom to be detachable from the crucible, the coil and the iron core. A container is placed below the furnace, and removed fragments of the crucible lining as well as dust are collected in this container, a dust shield being located between the container and the furnace and over the open top of the furnace.

But even when following the procedure described in this British Pat. No. 1,448,954 it is difficult to avoid the formation of a dusty atmosphere in the vicinity of the furnace.

The present invention aims to provide an apparatus for removing the lining of a crucible furnace which does not have the disadvantages mentioned above.

DISCLOSURE OF THE INVENTION

According to the invention, an apparatus for removing the lining of a crucible furnace comprises a tubular support which is disposable substantially in the axial direction of the furnace, a power-driven tool for breaking up the lining, means mounting this tool for movement along the tubular support with the tool in engagement with the lining, drive means operable from outside the furnace for moving the mounting means along the tubular support, and suction means connected to the tubular support for extracting, through the tubular support, dust and lining fragments produced during the operation of the tool.

When employing the apparatus in accordance with the invention, it is possible to provide a substantially dust-free working environment for the operator, while at the same time obtain a good control of the operation of the tool. The operation of the apparatus can be automated in a simple manner, and the operator need not even be near the furnace during the lining-removal work.

BRIEF DESCRIPTION OF THE DRAWING

The invention will now be described, by way of example, with reference to the accompanying drawing, in which.

DESCRIPTION OF PREFERRED EMBODIMENT

Figure 1:
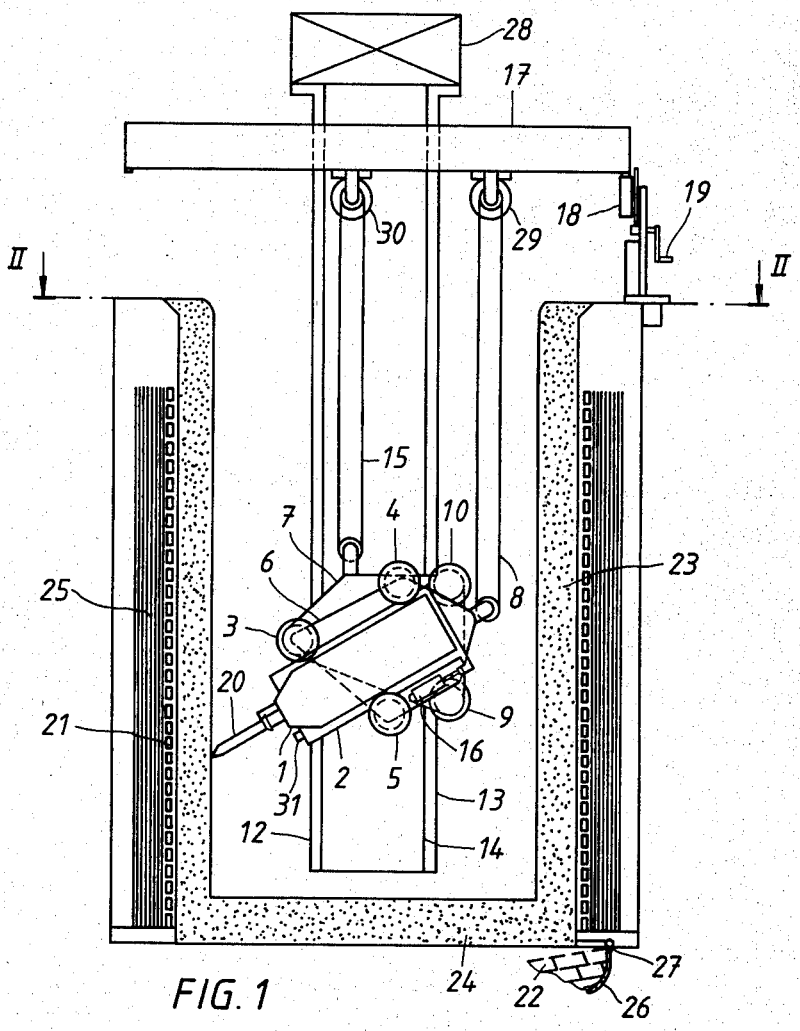
FIG. 1 is a schematic sectional side view of a crucible furnace, in the interior of which there is shown an apparatus in accordance with the invention for removing the crucible lining.

FIG. 1 shows a crucible furnace comprising a coil 21 and an iron core 25. Inside the coil 21 and the core 25 is a refractory lining 23, for example of quartzite, having a bottom 24. Below the furnace lining 23 is an openable furnace bottom 22, only a part of which is shown in a partly opened position, and which, in the embodiment illustrated, consists of refractory bricks enclosed in a metallic cap 26. When it is desired to remove the lining 23, the furnace bottom 22 is moved aside, for example, on hinges 27.

Figure 2:
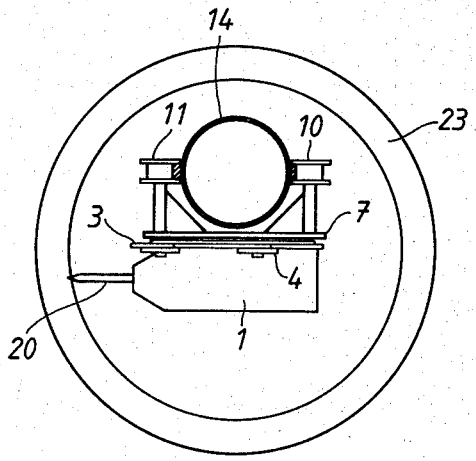
FIG. 2 is a sectional view on the line II—II of FIG. 1 of the crucible lining and the lining-removing apparatus.

FIGS. 1 and 2 show an apparatus for removing the lining 23, comprising a chisel 20 with a driver means 1 mounted on a carriage 2. The chisel 20 is preferably pneumatically operated and of the hammer drill type, but it is, of course, possible instead to arrange hydraulic operation or some other form of operation. Normally, however, hammer drilling is the most appropriate method for breaking up the lining 23 that is to be removed. The carriage 2 is movable, by means of a double-acting pneumatic piston and cylinder assembly 16, in the direction of the longitudinal axis of the chisel 20, the carriage being supported by wheels 3, 4 and 5 which are rotatably mounted on a plate 6. The plate 6 is mounted on a support plate 7 and is turnable relative to the plate 6 about a pivoting axis which coincides with the axis of rotation of the wheel 3, but this is, of course, only one example of how the problem may be solved. By means of a cable-winding mechanism 8, shown only in FIG. 1, the plate 6 may be turned through an angle of 90° relative to the plate 7, in order to bring the chisel 20 into positions where it can engage either the wall of the lining 23 or the bottom 24. The cable winding mechanism 8 is driven from outside the furnace, for example, by means of a motor 29 mounted on a table 17, the purpose of which is described more fully hereinafter.

Three further wheels 9, 10 and 11 are rotatably mounted on the plate 7, the wheel 11 having the same axle as the wheel 3. The wheels 9–11 engage rails or guides 12 and 13, which are welded on a substantially vertically disposed support tube 14, these rails or guides being disposed parallel to the axis of the tube 14. The plate 7, and with it the chisel 20, is moved vertically with respect to the tube 14 by means of a cable winding mechanism 15, shown only in FIG. 1. The cable mechanism 15 is driven from outside the furnace, for example, by means of a motor 30 mounted on the table 17. Apart from acting as a support for the chisel 20, the tube 14 is provided with a suction device 28 at its upper end and serves to suck out dust and small fragments of the lining being removed from a region in the vicinity of the bottom 24.

For the purpose of rotating the lining-removing means in a horizontal plane, the support tube 14 is fixed to a table 17 which is rotatable about an axis which coincides with the longitudinal axis of the lining 23. The table 17 rests on three supporting wheels, only one of which, designated by the numeral 18, is shown in FIG. 1. The wheel 18 may be driven manually by means of a crank 19 and gear wheels for the purpose of rotating the table 17 and with it the tube 14. It is, of course, also possible to arrange motorized operation of the table 17. By using, for example, worm gear motors for driving the rotatable table 17 and the cable winding mechanisms 8 and 15, in combination with a programming means, the entire lining removal procedure can be automated.

In order to avoid the cutting edge or point of the chisel 20 from reaching the furnace coil 21 and damaging it, the length of the chisel and/or its inclination to the horizontal is chosen so that the point cannot penetrate to within less than 20 or 30 mm from the furnace coil. This may be arranged by providing a mechanical stop means 31 for the movement of the carriage 2 on the plate 6 or by providing a mechanical stop means (not shown) either at the chisel 20 or in the drive means 1.

The above-described lining removing means is used as follows: The furnace is prepared for removal of its lining 23 by swinging the furnace bottom 22 away from the lining bottom 24, arranging the table 17 and support tube 14 in the position shown in the drawing and then lowering the chisel 20, by means of the cable winding mechanism 15, to a position near the bottom 24 of the lining. Using the cable winding mechanism 8, the chisel 20 is moved into a suitable position for engaging the bottom 24. The drive means 1 is then started and the chisel 20 engaged with the bottom 24, using the piston and cylinder assembly 16, in order to make a hole in the bottom 24. The cut away material falls down into a container (not shown) placed below the furnace. During this breaking up of the bottom 24, the suction device 28 is switched on, and it remains switched on for the remainder of the lining removal procedure.

When a hole has been formed in the bottom 24, the cutting away of the wall of the lining 23 around the longitudinal axis of the furnace is started. This cutting is suitably started at the bottom 24 and proceeds upwardly by raising the chisel 20, using the cable-winding mechanism 15, towards the highest point of the crucible and with simultaneous rotation of the table 17. Of course, if desired the cutting away of the wall of the lining may commence at the highest point of the crucible and then proceed downwardly. During the cutting away of the wall of the lining, coarse pieces of the lining will fall down through the hole in the bottom 24 into the container, whereas finer pieces, fragments and dust are sucked out through the tube 14 without being dispersed into the space above the furnace crucible. The person operating the lining-removing means will not be affected by the dust to any significant extent.

What is claimed is:

1. An apparatus for removing the lining of a crucible furnace, said crucible furnace having a central axis, the lining-removing apparatus comprising a tubular support element extendable substantially along the central axis of said crucible furnace, said tubular support element having an upper end located outside of said crucible furnace and an open lower end locatable within said crucible furnace, said tubular support element including guide means extending longitudinally thereof, vacuum-generating means attached to said tubular support element to create a vacuum therein for removing debris from the crucible furnace upwardly therethrough, a hammer drill mounted on the guide means of said tubular support element, said hammer drill including a tool for contacting and breaking up the lining of the crucible furnace, and drive means connected to said hammer drill for moving said hammer drill along the guide means of said tubular support, said drive means being operable from outside of said crucible furnace.

2. The apparatus as defined in claim 1 wherein said tool is a chisel.

3. The apparatus as defined in claim 1 wherein said hammer drill is mounted on a support plate, and wherein said drive means includes a motor located outside of said crucible furnace and a connector means connected between said motor and said support plate.

4. The apparatus as defined in claim 3 wherein said connector means comprises a cable.

5. The apparatus as defined in claim 3 wherein said guide means comprises at least one rail attached to the external surface of said tubular support element, and wherein said support plate includes at least one guide wheel rotatably attached thereto, each said guide wheel being engagable with a rail attached to the external surface of said tubular support element.

6. The apparatus as defined in claim 1 wherein said vacuum-generating means comprises a suction device connected to the upper end of said tubular support element.

7. The apparatus as defined in claim 1 including rotation means connected to said tubular support element for rotating said tubular support element about its longitudinal axis.

8. The apparatus as defined in claim 7 wherein said rotation means comprises a table to which the upper end of said tubular support element is connected, and movement means for rotating said table in a plane extending perpendicularly to the longitudinal axis of said tubular support element.

9. The apparatus as defined in claim 8 wherein said movement means comprises a number of rotatable support wheels on which said table is mounted.

10. The apparatus as defined in claim 1 wherein said hammer drill includes a driver element to which said tool is attached; a carriage to which said driver element is attached; a tool plate which mounts a number of roller wheels, said carriage being movably mounted by said roller wheels; and a piston and cylinder mechanism for moving said carriage with respect to said roller wheels and thus said tool plate such that said tool moves back and forth along its longitudinal axis.

11. The apparatus as defined in claim 10 wherein said support plate is attached to the guide means of said tubular support element, and wherein said tool plate is attached to said support plate so as to be pivotable about an angle of 90° with respect to said support plate.

12. The apparatus as defined in claim 11 wherein said hammer drill includes a stop means for limiting the depth of penetration of said tool into the lining of the crucible furnace.

* * * * *